US008132576B1

(12) United States Patent
Trottier

(10) Patent No.: US 8,132,576 B1
(45) Date of Patent: Mar. 13, 2012

(54) HAIR COLORING AGENT CAPSULE

(75) Inventor: Allan J. Trottier, Greenville, SC (US)

(73) Assignee: Quale, Inc. NH (US)

( * ) Notice: Subject to any disclaimer, the term of this patent is extended or adjusted under 35 U.S.C. 154(b) by 104 days.

(21) Appl. No.: 12/720,747

(22) Filed: Mar. 10, 2010

Related U.S. Application Data

(60) Provisional application No. 61/159,542, filed on Mar. 12, 2009.

(51) Int. Cl.
*A45D 19/18* (2006.01)

(52) U.S. Cl. ..... 132/270

(58) Field of Classification Search ..... 132/270, 132/221; 401/9–10; 220/571, 4.22, 4.23, 220/4.32
See application file for complete search history.

(56) References Cited

U.S. PATENT DOCUMENTS

| | | | | |
|---|---|---|---|---|
| 4,144,897 | A * | 3/1979 | Mosz | 132/270 |
| 4,503,870 | A * | 3/1985 | Peterson | 132/270 |
| 4,942,893 | A | 7/1990 | Trottier | |
| 5,143,218 | A * | 9/1992 | Brauckmann | 206/467 |
| 5,228,465 | A | 7/1993 | Hill | |
| 5,469,873 | A | 11/1995 | Guth | |
| 5,799,669 | A * | 9/1998 | Briggs | 132/208 |
| 6,666,215 | B1 | 12/2003 | Bulriss | |
| 2003/0135937 | A1 * | 7/2003 | Barrass et al. | 8/408 |
| 2004/0231690 | A1 * | 11/2004 | De Benedictis | 132/270 |
| 2008/0083418 | A1 * | 4/2008 | Glenn et al. | 132/208 |
| 2008/0257370 | A1 * | 10/2008 | Perry | 132/200 |
| 2009/0050171 | A1 * | 2/2009 | Barrass et al. | 132/208 |
| 2009/0084394 | A1 * | 4/2009 | Baker et al. | 132/208 |

FOREIGN PATENT DOCUMENTS

| | | | |
|---|---|---|---|
| EP | 251968 | A2 * | 1/1988 |
| GB | 2203645 | A | 10/1988 |

OTHER PUBLICATIONS

Machine translation of EP251968A2.*

* cited by examiner

*Primary Examiner* — Robyn Doan
*Assistant Examiner* — Jennifer Gill
(74) *Attorney, Agent, or Firm* — Michael J. Weins; Jeffrey E. Semprebon

(57) ABSTRACT

A capsule for containing a chemical coloring agent as it treats a lock of hair has a male side with a projection and a female side with a cavity, connected by a hinge that allows the projection and the cavity to be swung into sealing relationship with the hair trapped therebetween. A reinforcing pattern of interconnected elements form a region of one of the surfaces, the pattern forming an array of spaced-apart islands. The interconnected elements provide enhanced rigidity for the capsule and provide the capsule a better grip on the hair to maintain the capsule in place. The male side and/or female side may be provided with a trough positioned opposite the hinge to reduce overflow of the coloring agent, and can be provided with a well positioned near the hinge to allow the hair to more readily distribute itself when folded over.

20 Claims, 7 Drawing Sheets

HAIR COLORING AGENT CAPSULE

FIELD OF THE INVENTION

The present invention relates to capsules employed to contain a chemical agent in contact with a lock of hair while the agent acts to change the appearance of the hair.

BACKGROUND OF THE INVENTION

When treating hair with chemical coloring agents, it has been found advantageous to encapsulate locks of hair after applying the coloring agent thereto while the coloring agent acts to change the appearance of the hair. Such encapsulation serves to maintain the agent in close proximity to the hair and prevents dripping of the agent onto surfaces where it is not wanted. Clear capsules that allow a user to view the coloring process are taught in U.S. Pat. No. 4,942,893. These capsules can be formed from embossed plastic sheet stock to have a male side and a female side, connected by a hinge so as to be folded and locked together to encapsulate a lock of hair placed therein.

UK Patent Application 2 203 645 A teaches a capsule device which is similar to that taught in the '893 patent, but which is provided with one or more channels to facilitate the spread of the treatment agent through the encapsulated space containing the lock of hair. Other devices for maintaining chemical agents on the hair employ a combination of a foam lining with a plastic shell, such as taught in U.S. Pat. No. 5,228,465. The '465 device employs reinforcing ribs to increase its rigidity, enabling the device to be suitable for straightening hair as well as for coloring operations.

SUMMARY OF INVENTION

The present invention is for a capsule for use with a chemical agent to apply color to hair. This device provides a capsule into which a lock of hair and a treating solution are contained to highlight the lock of hair contained therein. The capsule can be formed from a sheet of material configured to provide a male side, terminating in a male side free end, and a female side, terminating in a female side free end, with a hinge region therebetween. The use of such capsules and their general structure are taught in U.S. Pat. No. 4,942,893.

The male side is embossed so as to provide a projection bounded by generally planar top surface and by a projection sidewall that is substantially normal to the top surface, the projection being surrounded by a male side lip that is planar and substantially parallel to the top surface of the projection. The projection has a projection distal end near the hinge region and a projection proximal end near a male side free end that is spaced apart from the hinge region (the projection proximal end will be closest in proximity to the scalp during the hair treatment).

The female side is embossed so as to form a cavity having a cavity distal end near the hinge region and a cavity proximal end near a female side free end that is spaced apart from the hinge region, the cavity being surrounded by a planar female side lip. The cavity is bound by a base surface that is generally planar and parallel to the female side lip, and by a cavity sidewall that is substantially normal to the base surface, and configured so as to sealably engage the cavity in the female side of the capsule with the projection of the male side when the projection is positioned in the cavity.

The engagement of the projection with the cavity can be secured by the use of interlocking protrusions on the projection sidewall and recesses in the cavity sidewall, where the protrusions and recesses are designed to releasably, lockably engage together so as to maintain the projection securely engaged in the cavity.

At least one of the base surface and the top surface has a first region with a reinforcing pattern of interconnected elements that are connected so as to provide an array of spaced-apart islands. These islands may reside either above or below the surface created by the interconnected elements. If only one of the surfaces has a first region with a reinforcing pattern embossed therein, it is preferred for first region of the top surface of the projection to be so embossed to add rigidity to the top surface, since the hair is typically positioned on this surface for application of the coloring agent to the hair, and thus the reinforcing pattern adds rigidity to this surface to provide more stable support for the hair residing thereon while the coloring agent is applied. It is preferred for the projection that the interconnected elements reside below the top surface to so as to provide a retaining region for the coloring agent. The interconnected elements also serve to provide a structure that obstructs flow of the coloring agent under gravity during the coloring process, and thus tend to maintain the coloring agent in place on the hair, particularly when the elements are arranged so as to prevent creating a line of site from the distal end to the proximal end.

In some embodiments where both the base surface and the top surface are provided with a region patterned with interconnecting elements, these regions are formed such that the islands and the interconnected elements are superimposed when the projection of the male side is engaged with the cavity of the female side. This superimposed configuration is felt to provide better gripping of the lock of hair contained in the capsule, particularly when the elements on one of the surfaces are raised thereabove while the elements on the other surface are recessed therefrom, and the edges of the elements are sloped so as to create a limited degree of interlocking of the elements when the male side is engaged with the cavity of the female side.

While the use of these patterns on the base surface and the top surface is preferably employed, it is further preferred that a region of these surfaces near the hinge not be provided with the reinforcing patterns so to as allow free movement of the hair in this region, allowing the hair to redistribute when it is folded over and thereby more evenly distribute the coloring agent therein to provide uniform coloring of the hair. In fact, it is further preferred that one or both of the sides have lower surface that is bowed or has a stepped-down region in the vicinity of the hinge to further promote the redistribution of the hair. Such a bowed or stepped-down region forms a well to accommodate the hair where it is typically folded over in close proximity to the hinge. It is further preferred that both sides be bowed.

In some embodiments, a trough is provided that communicates with the cavity proximal end. The trough may reside in the base surface of the cavity or in the top surface of the projection; a pair of troughs can be provided, one in each of the base surface and the top surface. These troughs serve to catch any excess coloring agent which might otherwise leak out from the proximal ends during the coloring process. Such leakage could result in irritation of the scalp of the party whose hair is being treated. In those cases where a troughs are provided, it can also be advantageous to have the troughs slightly spaced apart from the sidewalls to provide addition contact area between the female side and the male side when engaged.

The thickness of the sheet stock from which the capsule is fabricated also effects the stiffness of the capsule, but the weight factor of thicker material may increase the likelihood of slipping. A thickness of 12 to 14 mil is preferred. Less than 12 mil thick stock is likely to warp. Above 14 mil thickness, the capsule becomes too heavy to hold well when engaged with the hair. This also provides a shell that is less likely to deform during washing or when used in a heated environment such as under a dryer used to increase the temperature and thereby speed the chemical reaction to reduce the time needed to achieve the desired coloring effect.

In some embodiments of the present invention, the free ends of the male side and the female side are shaped so as to form an arc that is concave with respect to the edge of the sheet from which the capsule is formed, allowing the capsule to closely conform to the head contours of the individual whose hair is to be colored.

To aid the user in separating the male side and the female side after the coloring process has been completed, tabs can be provided that extend from the male side lip and the female side lip to allow the user to readily pry apart the male side and the female side. In one embodiment, these tabs narrow as they approach the proximal ends to reduce the likelihood of interference when multiple capsules are employed to color the hair of an individual.

BRIEF DESCRIPTION OF THE FIGURES

as shown in FIG. 1, the capsule is open for placement of a lock of hair on a male side of the capsule and for receiving a coloring agent applied to the hair. The male side has a projection which lockably, sealably engages a cavity in a female side to form a capsule to contain the hair and the coloring agent during the coloring process. Both a top surface of the projection and a base surface of the cavity have regions that are impressed with a reinforcing pattern that provides rigidity and serves to impede flow of the coloring agent to maintain it in place on the hair. In this embodiment, the reinforcing pattern is configured as a pattern of interconnected elements formed by crossing lines that form a series of rhomboidal islands. Both the male side and the female side are also provided with reservoir troughs to hold excess coloring agent that may flow towards the scalp of the individual to whom the capsule is applied. The female side and the male side are attached together by a hinge portion that allows the female side to be folded over the male side as shown in FIGS. 2-4 so as to entrap the hair and the coloring agent. Opposite the hinge portion, the female side and the male side each terminates in a curved free end adjacent the reservoir trough, these curved free ends providing a concave arc that allows the capsule to closely conform to the contour of the head of the individual whose hair is to be colored, thereby allowing the capsule to be positioned in close proximity to the individual's scalp.

FIG. 2 shows the coloring agent capsule as the female side begins to be folded over.

FIG. 3 is an exploded view that shows the coloring agent capsule shown in FIGS. 1 and 2 when the female side has been folded over so as to be superimposed over the male side; the view of FIG. 3 is shown looking downward from above the female side of the capsule, and looking toward the hinge ends of the sides. The projection of the male side nests in the cavity (shown in FIGS. 1 and 2) of the female side. The projection has a series of protrusions extending from a projection sidewall, and the cavity is provided with corresponding recesses in a cavity sidewall. The protrusion has a guide arrow indicating to the user which edge should be positioned against the head of the individual whose hair is being colored as well as indicating which surface the hair should be placed across.

FIG. 4 is a non-exploded view looking towards the free ends, showing the coloring agent capsule shown in FIGS. 1-3 when the male side and the female side have been pressed together to engage the protrusions of the projection with the recesses in the cavity; this engagement locks the protrusion and the cavity together during the time that the coloring agent acts on the hair. Since the reservoir troughs are positioned adjacent to the curved free edges, they reside close to the head of the individual during use and serve to catch any excess coloring agent that might otherwise leak out onto the scalp during the time that the agent acts on the hair. The male side and the female side have lips with tabs extending therefrom to allow the user to readily pry the sides apart when the coloring process has been completed.

DETAILED DESCRIPTION

Figure 1:
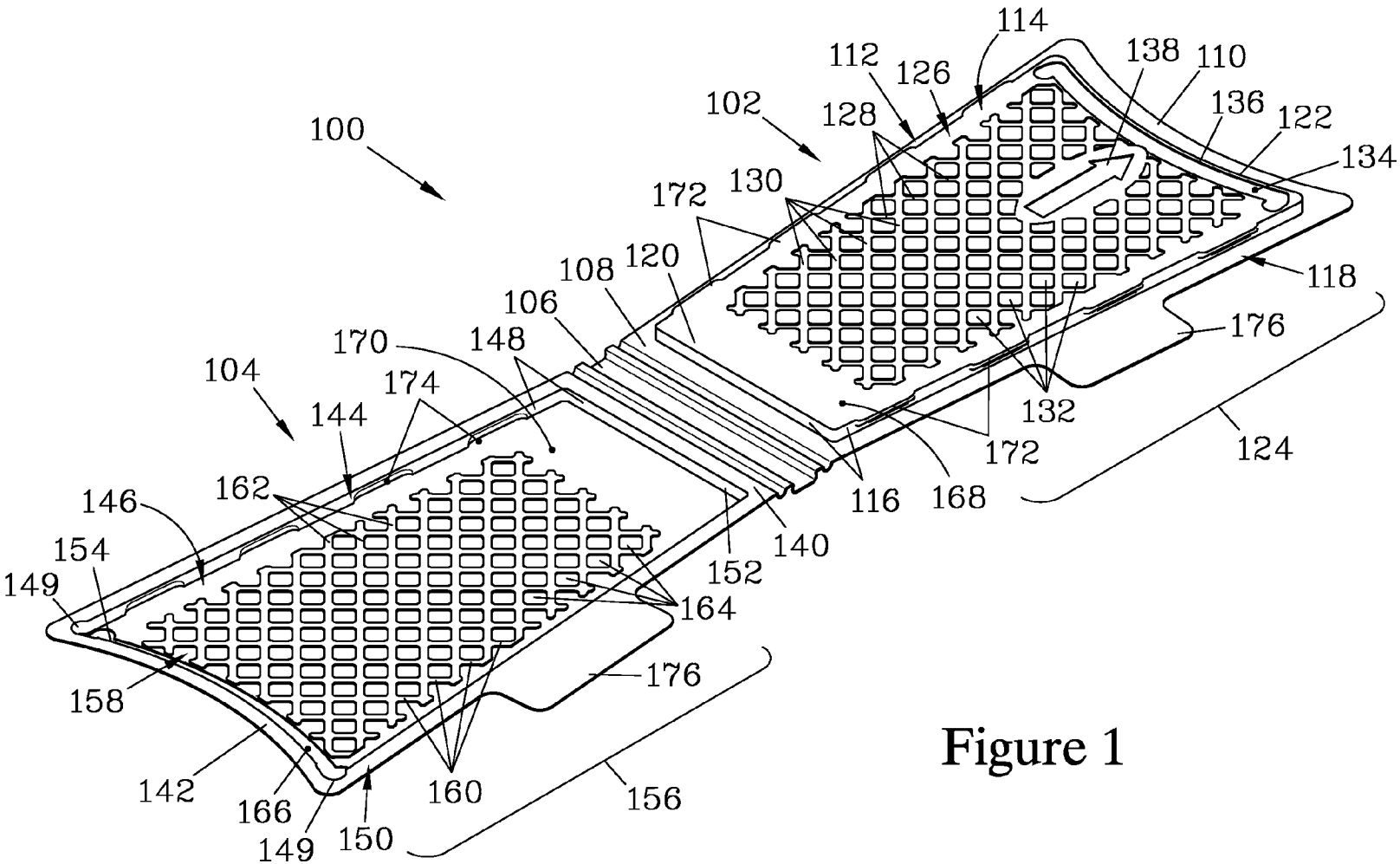
FIG. 1 is an isometric view of a coloring agent capsule that forms one embodiment of the present invention.
Figure 2:
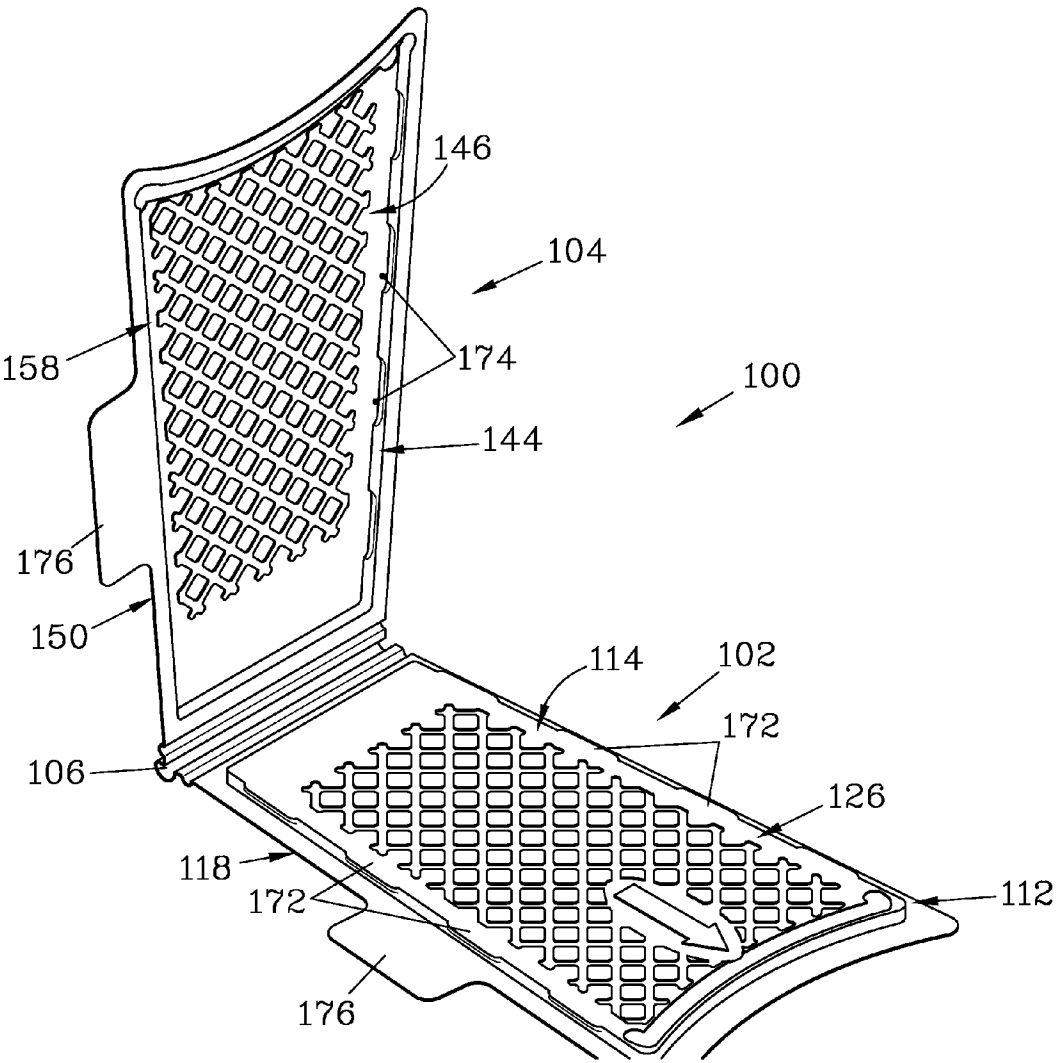
FIGS. 2-4 illustrate the coloring agent capsule shown in FIG. 1 when the female side is folded so as to be superimposed over the male side and the two portions then pressed together to lockably engage protrusions on the male side with recesses in the female side.
Figure 3:
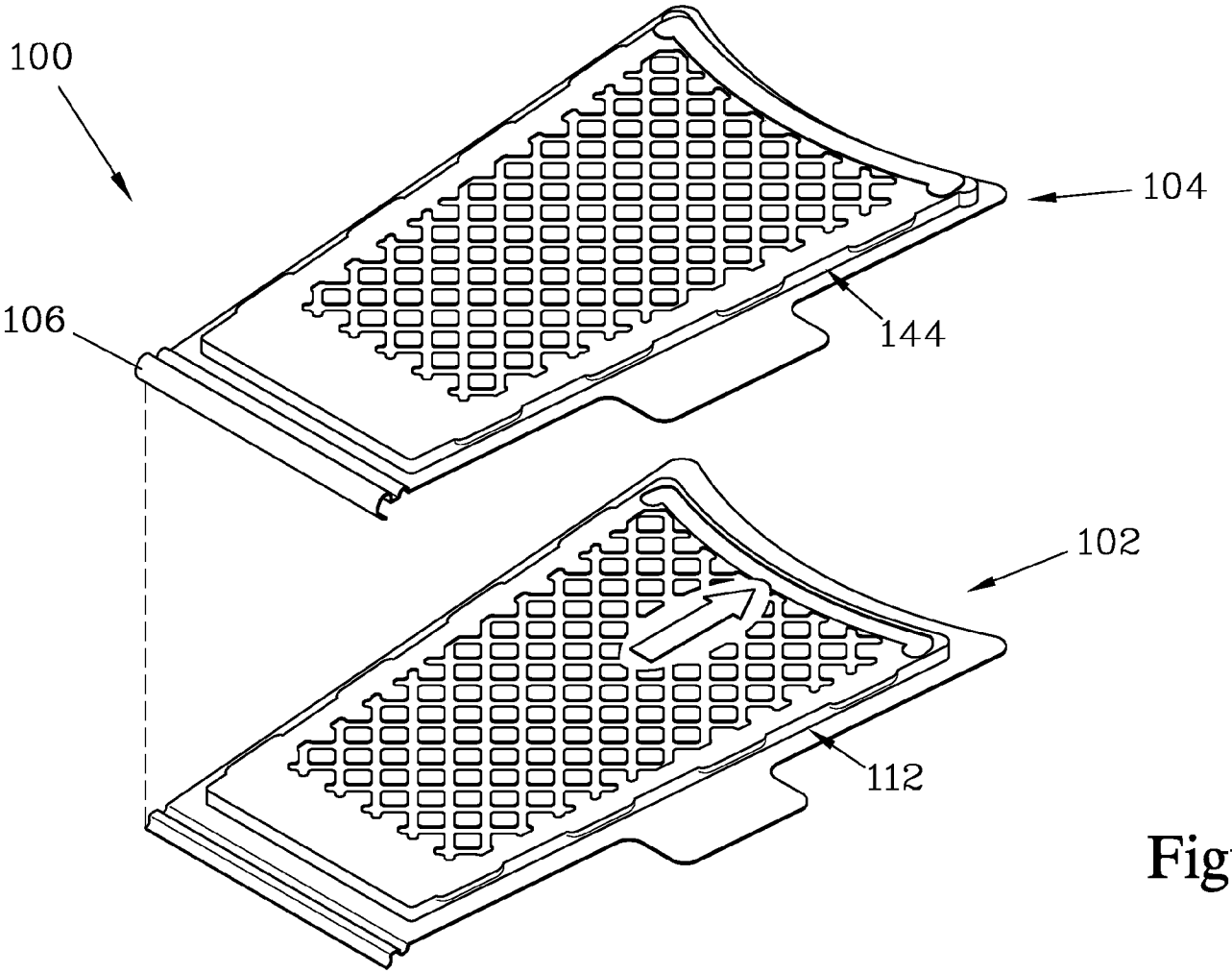
Figures 4, 6:
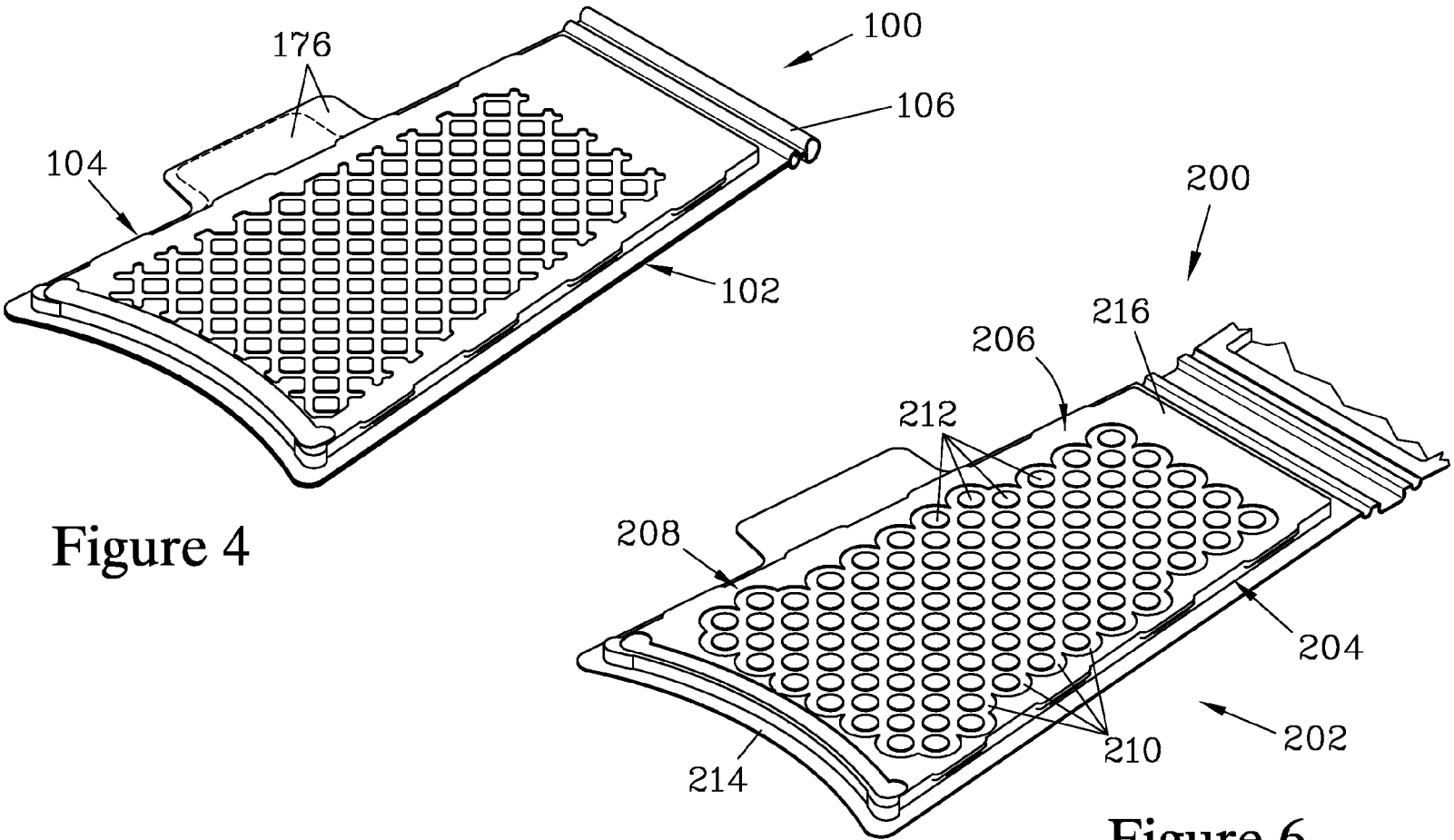
FIG. 6 is an isometric view of a male side and a hinge of a coloring agent capsule that forms another embodiment of the present invention; this capsule employs a different reinforcing pattern than that shown in FIGS. 1-5, this pattern being formed by an overlapping array of rings that provide an array of circular spaced-apart islands.

FIGS. 1-4 illustrate one embodiment of the present invention, a capsule 100 for containing a coloring agent applied to a lock of hair. The capsule 100 has a male side 102 and a female side 104 that are joined together by a hinge region 106 that allows the female side 104 to be folded over the male side 102 so as to be superimposed thereon (as shown in FIGS. 3 and 4). To simplify fabrication of the capsule 100, the male side 102, the female side 104, and the hinge region 106 can be formed from a single sheet of material.

The male side 102 has a male side hinge end 108, which joins with the hinge region 106, and a male side free end 110, which can be formed as a concave curve to conform to the scalp of an individual whose hair is to be colored. The male side 102 has an embossed section that forms a projection 112. This projection 112 is bounded by a top surface 114, which extends substantially in a plane, and by projection sidewalls 116. The projection 112 is surrounded by a planar male side lip 118 that extends substantially parallel to the top surface 114. The projection 112 has a projection distal end 120, which is located near the male side hinge end 108, where it will be distant from the scalp of the individual when the capsule 100 is in service. The projection 112 also has a projection proximal end 122, which is located near the male side free end 110 and can extend parallel thereto.

The top surface 114 of the projection 112 has an upper outer region 124 that is embossed with a reinforcing pattern 126 which, in this embodiment, is formed by a series of intersecting linear valleys (128, 130) that interconnect so as to form an array of spaced-apart islands 132 that are rhombus-shaped. In this embodiment, the linear valleys (128, 130) are recessed into the top surface 114, with the islands 132 being coplanar with the remainder of the top surface 114. The reinforcing pattern 126 provides increased rigidity for the top surface 114, and serves to provide support for a lock of hair when placed onto the top surface for application of the coloring agent onto the hair.

In the embodiment illustrated, the linear valleys (128, 130) are arranged such that they do not present a line of sight when viewed from the free end 110 in the direction of the hinge end 108. Such a configuration provides better gripping power on the hair, since strands entrapped therein to not have a direct path of slip as the weight of the capsule tries to pull the capsule off the hair. Similarly, the lack of a direct line of sight creates resistance to flow of the chemical agent, thereby assisting in maintaining it in place on the hair.

The top surface 114 is also provided with a top surface trough 134 that extends parallel to and in close proximity to the projection proximal end 122, being separated therefrom by a top surface ridge 136. When the capsule 100 is in service with the male side 102 and the female side 104 lockably engaged together, the top surface trough 134 provides a reservoir into which excess coloring agent can collect, while the top surface ridge 136 serves to obstruct such excess coloring agent from flowing out beyond the projection proximal end 122.

It has been found that a lock of hair to be colored can be positioned in the capsule 100 more readily when placed across the male side 102 than when placed on the female side 104. To provide a reminder to the user that the hair should be placed on the male side 102, the top surface 114 can be provided with an index mark 138 embossed therein. The index mark 138 can also serve as a reminder to the user as to which end of the male side 102 should be positioned against the scalp of the individual prior to placing the hair thereon.

The female side 104 of the capsule 100 has a female side hinge end 140, which joins with the hinge region 106, and a female side free end 142, which can be formed as a concave curve similar to that of the male side free end 110. The female side 104 is embossed to form a cavity 144 bounded by a base surface 146 and cavity sidewalls 148; the cavity sidewalls 148 generally conform to the shape of the projection sidewalls 116, with the exception of distal end corners 149 where the cavity sidewalls 148 bow outward to facilitate the swing in and out of the projection 112. The cavity 144 is surrounded by a planar female side lip 150 that extends substantially parallel to the base surface 146, which is substantially planar. When the capsule 100 is folded with the female side 104 superimposed over and lockably engaged with the male side 102, the base surface 146 extends parallel to the top surface 114 of the projection 112. The cavity has a cavity distal end 152, which is located near the female side hinge end 140, and a cavity proximal end 154, which is located near the female side free end 142 and can extend parallel thereto.

The base surface 146 of the cavity 144 has an base surface outer region 156 that is embossed with a reinforcing pattern 158 which, in the capsule 100 illustrated, is formed by a series of intersecting linear ridges (160, 162) that interconnect and form an array of spaced-apart islands 164 in a manner that is nestable with the reinforcing pattern 126 of the top surface 114. In the embodiment shown in FIG. 1, the linear ridges (160, 162) are raised from the base surface 146, and the islands 164 are recessed with respect to the linear ridges (160, 162), being co-planar with the remainder of the base surface 146. The reinforcing pattern 158 is positioned so as to become superimposed directly on the reinforcing pattern 126 of the projection 112, providing an interlocking action that serves both to grip the hair and to impede the flow of the coloring agent under the force of gravity. The gripping action of the superimposed patterns (126, 158) is felt to be superior to that provided by transverse ridges and grooves, such as taught in U.S. Pat. No. 4,942,893. The increased rigidity of the top surface 114 and the base surface 146 has also been found to reduce warping of the capsule 100 over time and provide an increased service life compared to earlier capsules. This reduced susceptibility to warping is particularly advantageous when the capsule is used in combination with a heat source to speed the coloring process. Increased rigidity can be provided by fabricating the capsule 100 from a thicker material; however, it is desirable to maintain the capsule 100 relatively lightweight so that it will maintain its position on the head of the individual during the coloring procedure. It is felt that employing material having a thickness of 0.012"-0.015" provides a good balance between rigidity and overall weight.

Similarly to the top surface 114 of the projection 112, the base surface 146 of the cavity 144 is provided with a base surface trough 166 that extends adjacent to the one of the cavity sidewalls 148 that defines the cavity proximal end 154. In service, the base surface trough 166 extends the reservoir created by the top surface trough 134 for collection of excess coloring agent.

In this embodiment, the top surface 114 has a substantially planar region 168, which is free from the linear recesses (128, 130), in addition to the reinforced upper outer region 124. The free planar region 168 allows the hair that it contacts to redistribute, this free movement of the hair distributing the solution therein and providing uniform coloring of the hair. Similarly, the bottom base surface 146 has a substantially planar region 170 which is free of reinforcing ridges and is coplanar with the surface bearing the linear ridges (160, 162). This will further promote the free movement of the hair in this region of the capsule 100.

FIG. 2 illustrates the capsule 100 as it begins to be folded at the hinge region 106 to bring the female side 104 over the male side 102. The projection 112 of the male side 102 is provided with a series of locking protrusions 172 positioned around the top surface 114, while the female side 104 has a series of locking recesses 174 positioned in the cavity 140 and configured to lockably, releasably engage the locking protrusions 172 when the female side 104 is superimposed over the male side 102 and the sides (102, 104) pressed together to bring the base surface 146 of the cavity 144 against the lock of hair positioned on the top surface 114 of the projection 112. FIG. 3 is an exploded view of the capsule 100 when the female side 104 is superimposed over the male side 102, while FIG. 4 is an assembled view when the female side 104 has been brought into lockable engagement with the male side 102. It should be noted that, while the capsule 100 is illustrated as being formed from an opaque material, it is frequently preferred for the capsule 100 to be formed from a clear or translucent material to allow the user to judge the effect of the coloring agent during the coloring process.

When the coloring process has been completed, the male side 102 and the female side 104 are pried apart to release the lock of hair contained in the capsule 100. To facilitate prying the sides (102, 104) apart, the lips (118, 150) are each provided with tabs 176 extending therefrom. The tabs 176 are at least partially offset from each other as shown in FIG. 4 to allow them to be readily pried apart.

Figure 5:
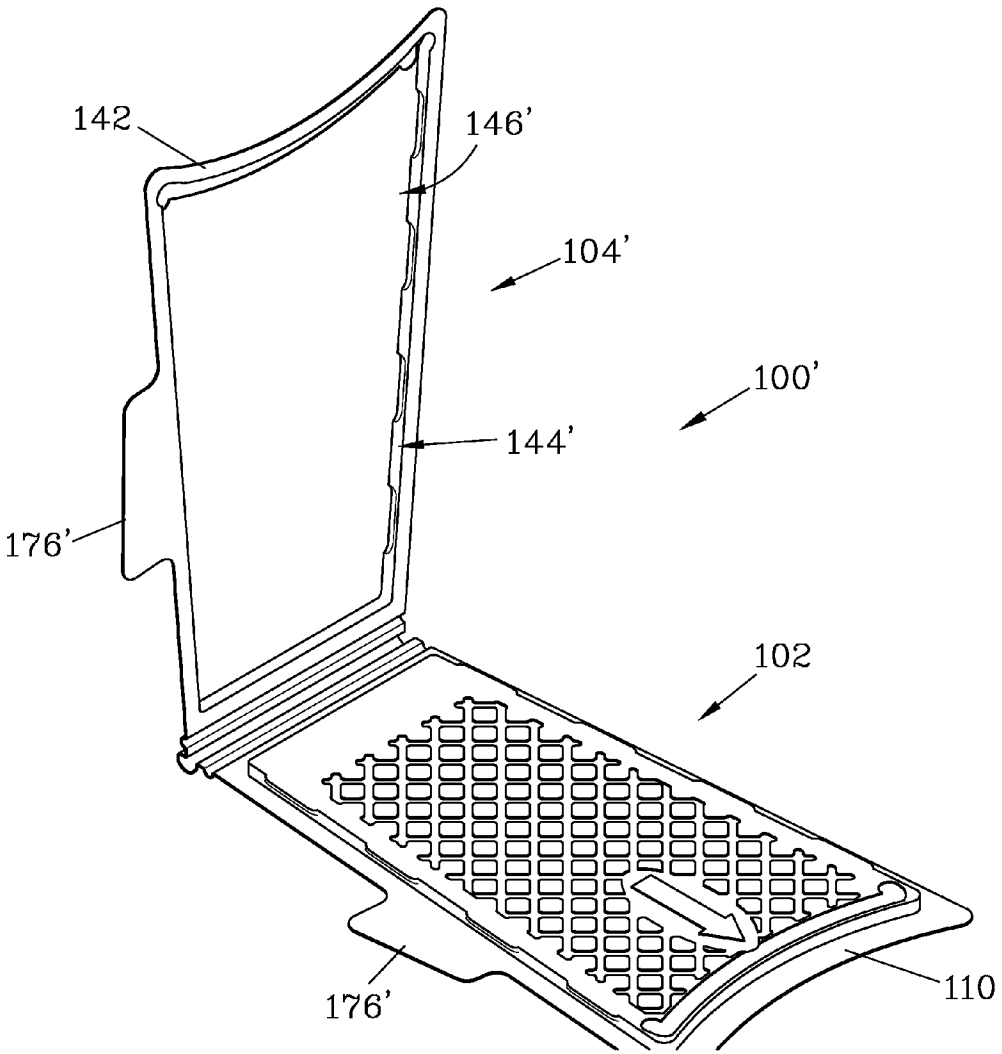
FIG. 5 is an isometric view of another embodiment of the present invention, which has many features in common with the embodiment shown in FIGS. 1-4, but where the cavity has a base surface that is not embossed. This embodiment also differs in the configuration of the tabs extending from the lips; the tabs of this embodiment are narrower near the scalp of the user to prevent interference when multiple capsules are applied at the same time.

FIG. 5 is an isometric view of a capsule 100' that has many features in common with the capsule 100, but where a female side 104' has a cavity 144' with a base surface 146' that is not embossed with a reinforcing pattern.

The capsule 100' also differs in that it has tabs 176' that are tapered so as to narrow as they approach the free ends (110, 142). This reduces their size in proximity to the free ends (110, 142) to reduce the likelihood of interference with other capsules 100' when multiple capsules 100' are applied to the hair of the individual.

FIG. 6 is a partial isometric view of a capsule 200 that forms another embodiment of the present invention. The capsule 200 again has many features in common with the capsule 100, but has a male side 202 with a projection 204 having a top surface 206 that has a different reinforcing pattern 208 embossed therein. The reinforcing pattern 208 is formed as an array of overlapping rings 210, each surrounding a circular island 212. The rings 210 shown are configured so as to avoid creating a direct line of sight between a male side free end 214 and a male side hinge end 216.

Figure 7:
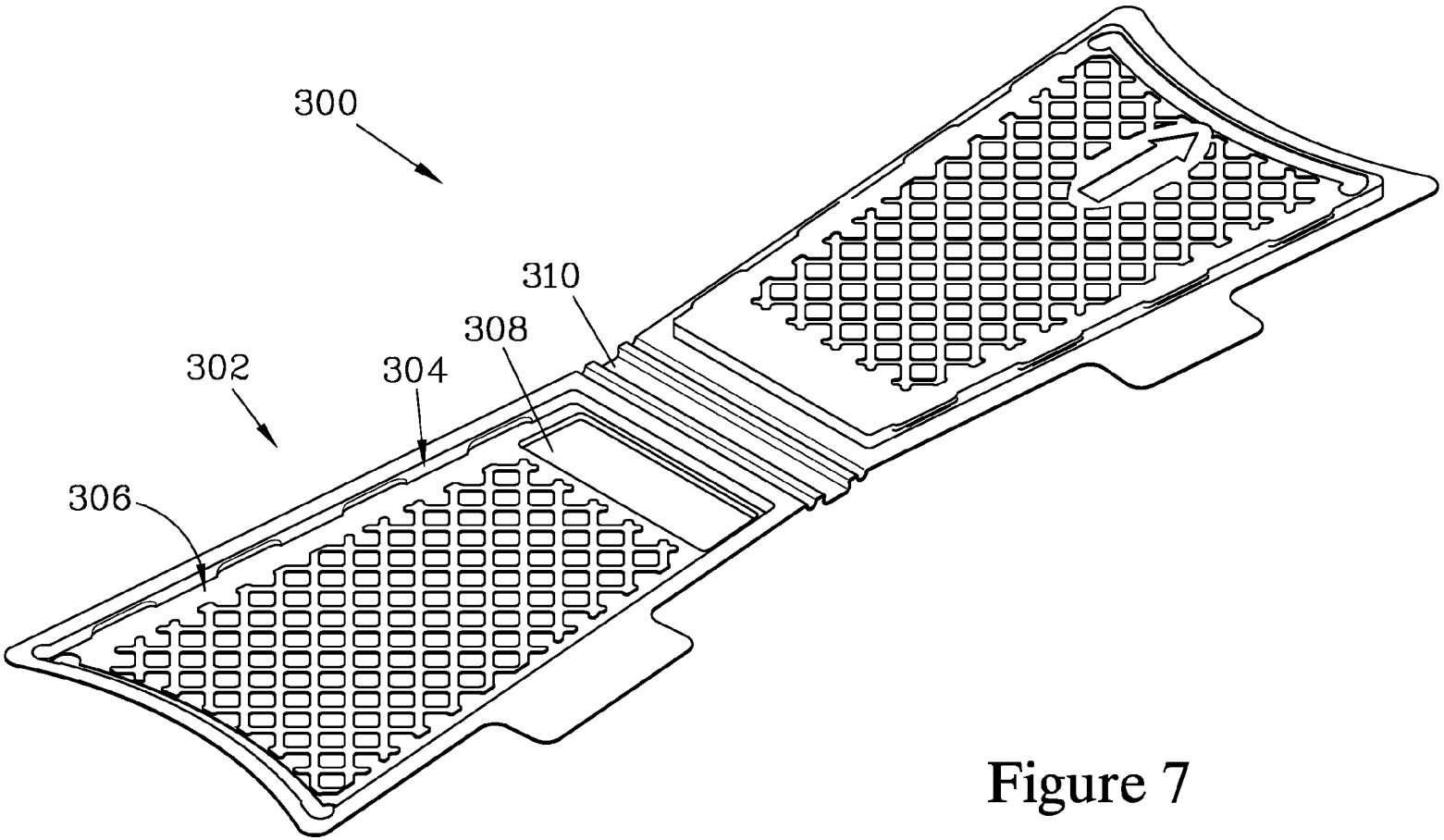
FIG. 7 illustrates another embodiment of the present invention, which is similar to the embodiment shown in FIG. 1, but which has a well formed in the bottom surface of the female side of the capsule in a region in close proximity to the hinge.

FIG. 7 is an isometric view of a capsule 300 that forms another embodiment of the present invention. The capsule 300 again has many features in common with the capsule 100, but differs in that the female side 302 has a cavity 304 with a base surface 306 which has a well 308 which is in close proximity to a hinge region 310. This increases the entrapped volume in this portion of the cavity 304 when the capsule 300 is closed, and allows a long lock of hair to be folded back on itself and provide adequate freedom of this lock to allow repositioning of the hair enclosed thereunder to readjust and promote uniform coloring.

Figure 8:
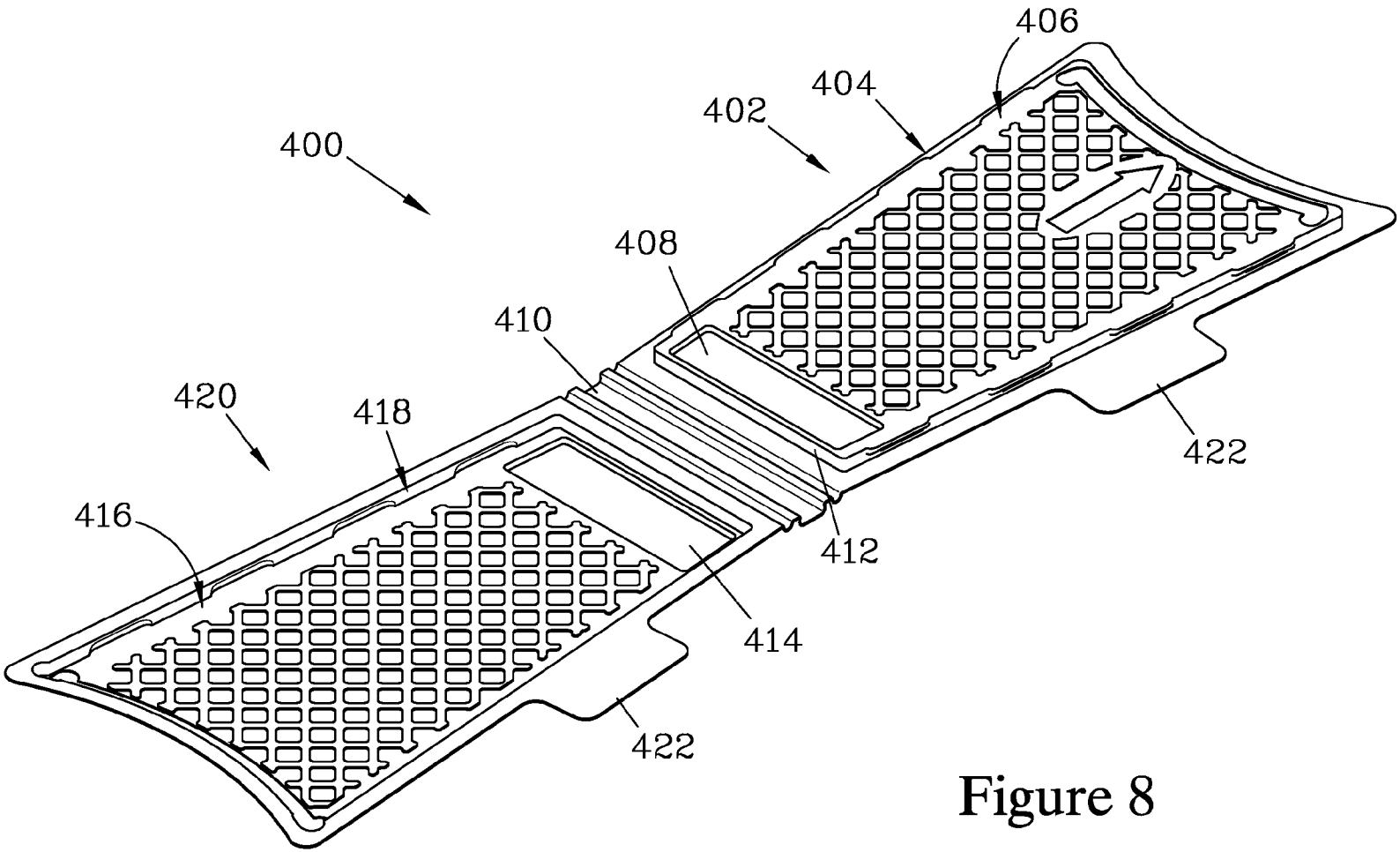
FIG. 8 illustrates another embodiment, which is similar to that shown in FIG. 7, but where the top surface of the male side has a well in the protrusion in close proximity to the hinge. This embodiment also has tabs which are offset with respect to each other such that they each extend beyond the other when the male side and the female side of the capsule are superimposed.

FIG. 8 is an isometric view of a capsule 400 that forms another embodiment of the present invention. The capsule 400 has many features in common with the capsule 300, but differs in that it has a male side 402 having a protrusion 404 with a top surface 406 which has a well 408 which is in close proximity to a hinge region 410. This allows a long lock of hair to be folded back on itself with freedom to redistribute to promote more uniform coloring. To avoid leakage, the well 408 should be spaced apart from a distal end sidewall 412 of the protrusion 404. The capsule 400 also has a well 414 in a base surface 416 of a cavity 418 of a female side 420, and tabs 422 that are positioned so as to be offset with respect to each other such that, when the male side 402 is engaged with the female side 420, each of the tabs 422 extends beyond the other on one side.

While the novel features of the present invention have been described in terms of particular embodiments and preferred applications, it should be appreciated by one skilled in the art that substitution of materials and modification of details can be made without departing from the spirit of the invention.

What I claim is:

1. A capsule for containing a hair coloring agent, the capsule comprising:

a male side formed of a sheet of material having a male side hinge end and a male side free end, said male side being embossed so as to provide a projection bounded on all sides by projection sidewalls and a top surface;

a female side formed of a sheet of material having a female side hinge end and a female side free end, said female side being embossed so as to form a cavity having a distal end near said female side hinge end and a proximal end near said female side free end, said cavity being bounded on all sides by cavity sidewalls and a base surface, said projection sidewalls and said cavity sidewalls being configured to sealably engage together when said projection resides in said cavity, at least one of said base surface and said top surface having a region that is further embossed with a reinforcing pattern of interconnected elements that form boundaries around an array of islands that are spaced apart; and a hinge region joining said female side hinge end to said male side hinge end such that said female side and said male side can be swung into a sealing relationship as said free ends are swung into contact.

2. The hair coloring agent capsule of claim 1 wherein said region that is further embossed is on said top surface of said projection and forms a top surface outer region having said reinforcing pattern of interconnected elements so connected so as to provide said array of isolated islands therebetween.

3. The hair coloring agent capsule of claim 2 wherein said pattern of interconnected elements on said top surface outer region are depressed into said top surface so as to form an interpenetrating array of valleys.

4. The hair coloring agent capsule of claim 3 wherein said base surface of said cavity also has a region that is further embossed, which forms a base surface outer region having a pattern of interconnected elements so connected so as to form an array of isolated islands.

5. The hair coloring agent capsule of claim 4 wherein said pattern of interconnected elements on said base surface outer region are raised above said top surface and are positioned such that said array of isolated islands of said base surface are superimposed on said isolated islands of said top surface when said female side and said male side are sealed together.

6. The hair coloring agent capsule of claim 3 wherein said pattern of interconnected elements are arranged such that they do not present a line of sight when viewed from said male side free end in the direction of said male side hinge end.

7. The hair coloring agent capsule of claim 6 further comprising:

a trough positioned so as to communicate with said proximal end of said cavity when said male side and said female side are swung into a sealing relationship.

8. The hair coloring agent capsule of claim 7 further comprising:

a well positioned in said base surface of said cavity and in close proximity to said hinge region.

9. The hair coloring agent capsule of claim 7 further comprising:

a well positioned in said top surface of said protrusion and in close proximity to said hinge region.

10. The hair coloring agent capsule of claim 7 wherein said male and female side free ends are each shaped as a concave arc.

11. The hair coloring agent capsule of claim 10 further comprising:

a series of recesses in said cavity sidewalls; and a corresponding series of protrusions protruding from said projection sidewalls, each of said protrusions being configured and positioned to snappably engage one of said series of recesses when said female side and said male side are swung into a sealing relationship.

12. The hair coloring agent capsule of claim 11 further wherein said hinge ends of said female side and said male side are shorter than said free ends, the hair coloring agent capsule further comprising:

a female side lip which, in part, extends between said female side hinge end and said female side free end; and a male side lip which, in part, extends between said male side hinge end and said male side free end.

13. The hair coloring agent capsule of claim 12 further comprising:

a female side tab extending said female side lip and residing between said female side hinge end and said female side free end; and a male side tab extending said male side lip and residing between said male side hinge end and said male side free end, said male side lip being positioned so as to be superimposed over a portion of said female side tab when said female side and said male side are swung into a sealing relationship.

14. The hair coloring agent capsule of claim 13 wherein said tabs are trapezoidal with the narrower portion thereof closest to said hinge.

15. The hair coloring agent capsule of claim 13 wherein said tabs are offset with respect to each other such that each extends beyond the other on at least one side when said female side and said male side are swung into a sealing relationship.

16. The hair coloring agent capsule of claim 4 wherein said top surface of said protrusion further comprises:

a top surface substantially planar region disposed between said top surface outer region and said male side hinge end.

17. The hair coloring agent capsule of claim 16 wherein said base surface of said cavity further comprises:

a base surface substantially planar region disposed between said base surface outer region and said cavity distal end.

18. The hair coloring agent capsule of claim 1 wherein said base surface of said cavity has a base surface outer region having a pattern of interconnected elements so connected so as to form an array of isolated islands therebetween.

19. The hair coloring agent capsule of claim 18 wherein said pattern of interconnected elements are arranged such that they do not present a line of sight when viewed from said female side free end in the direction of said female side hinge end.

20. The hair coloring agent capsule of claim 19 wherein said base surface of said cavity further comprises:

a base surface substantially planar region disposed between said base surface outer region and said cavity distal end.

* * * * *